US009670587B2

(12) United States Patent
Pascall et al.

(10) Patent No.: US 9,670,587 B2
(45) Date of Patent: Jun. 6, 2017

(54) ROLL-TO-ROLL LIGHT DIRECTED ELECTROPHORETIC DEPOSITION SYSTEM AND METHOD

(71) Applicant: Lawrence Livermore National Security, LLC, Livermore, CA (US)

(72) Inventors: Andrew J. Pascall, Livermore, CA (US); Joshua Kuntz, Livermore, CA (US)

(73) Assignee: Lawrence Levermore National Security, LLC, Livermore, CA (US)

( * ) Notice: Subject to any disclaimer, the term of this patent is extended or adjusted under 35 U.S.C. 154(b) by 0 days.

(21) Appl. No.: 15/015,062

(22) Filed: Feb. 3, 2016

(65) Prior Publication Data

US 2016/0222538 A1 Aug. 4, 2016

Related U.S. Application Data

(60) Provisional application No. 62/111,461, filed on Feb. 3, 2015.

(51) Int. Cl.
*C25D 13/22* (2006.01)

(52) U.S. Cl.
CPC ..... *C25D 13/22* (2013.01)

(58) Field of Classification Search
CPC ..... C25D 13/22
See application file for complete search history.

(56) References Cited

U.S. PATENT DOCUMENTS 3,850,627 A * 11/1974 Wells ..... G03G 17/04 430/34
4,130,359 A * 12/1978 Groner ..... G03G 17/04 399/131

(Continued)

OTHER PUBLICATIONS

Pascall, et al., "Light-Directed Electrophoretic Deposition: A New Additive Manufacturing Technique for Arbitrarily Patterned 3D Comosites" Adv. Mater., vol. 26, No. 14, pp. 2252-2256 (Apr. 2014).

(Continued)

*Primary Examiner* — Kishor Mayekar
(74) *Attorney, Agent, or Firm* — James S. Tak

(57) ABSTRACT

A roll-to-roll light directed electrophoretic deposition system and method advances a roll of a flexible electrode web substrate along a roll-to-roll process path, where a material source is positioned to provide on the flexible electrode web substrate a thin film colloidal dispersion of electrically charged colloidal material dispersed in a fluid. A counter electrode is also positioned to come in contact with the thin film colloidal dispersion opposite the flexible electrode web substrate, where one of the counter electrode and the flexible electrode web substrate is a photoconductive electrode. A voltage source is connected to produce an electric potential between the counter electrode and the flexible electrode web substrate to induce electrophoretic deposition on the flexible electrode web substrate when the photoconductive electrode is rendered conductive, and a patterned light source is arranged to illuminate the photoconductive electrode with a light pattern and render conductive illuminated areas of the photoconductive electrode so that a patterned deposit of the electrically charged colloidal material is formed on the flexible electrode web substrate.

9 Claims, 4 Drawing Sheets

(56) References Cited

U.S. PATENT DOCUMENTS

2009/0233327 A1* 9/2009 Lau ..... B03C 11/00
435/29
2011/0250467 A1 10/2011 Kuntz et al.

OTHER PUBLICATIONS

Oakes, The 60 Second Battery: Roll-to-Roll Nanomanufacturing of Pristine Hybrid Nanomaterials for Battery Design and Assembly, 5th International Conference on Electrophoretic Deposition, pp. 2252-2256 (2014).

* cited by examiner

ROLL-TO-ROLL LIGHT DIRECTED ELECTROPHORETIC DEPOSITION SYSTEM AND METHOD

CROSS-REFERENCE TO RELATED APPLICATIONS

This application claims the benefit of U.S. provisional application No. 62/111,461 filed Feb. 3, 2015, which is incorporated by reference herein.

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND

The present invention relates to electrophoretic deposition systems and methods and more particularly to a system and method for manufacturing 3D assemblies of particles or films using transient light patterning of an electrode and electrophoretic deposition in a roll-to-roll process.

Some examples of electrophoretic deposition systems and methods known in the art are as follows. U.S patent publication No. 2011/0250467 describes a method using a light patterned photoconductor to selectively deposit different materials in different regions on the conductor using electrophoretic deposition. And the article by Oakes, Landon, Trevor Hanken, Rachel Carter, William Yates, and Cary L. Pint, entitled "Roll-to-Roll Nanomanufacturing of Hybrid Nanostructures for Energy Storage Device Design" *ACS Applied Materials & Interfaces*, describes a roll-to-roll electrophoretic deposition system for depositing uniform thin films of materials onto a flexible tape.

SUMMARY

In one exemplary embodiment, the present invention includes a roll-to-roll light-directed electrophoretic deposition system, comprising: means for advancing a roll of a flexible electrode web substrate along a roll-to-roll process path; a material source positioned along the process path to provide on the flexible electrode web substrate a thin film colloidal dispersion of electrically charged colloidal material dispersed in a fluid; a counter electrode positioned along the process path to come in contact with the thin film colloidal dispersion opposite the flexible electrode web substrate, wherein one of the counter electrode and the flexible electrode web substrate is a photoconductive electrode; a voltage source operably connected to produce an electric potential between the counter electrode and the flexible electrode web substrate that induces electrophoretic deposition on the flexible electrode web substrate when the photoconductive electrode is rendered conductive; and a patterned light source arranged to illuminate the photoconductive electrode with a light pattern and render conductive illuminated areas of the photoconductive electrode so that a patterned deposit of the electrically charged colloidal material is formed on the flexible electrode web substrate.

In another exemplary embodiment, the present invention includes a roll-to-roll light-directed electrophoretic deposition system, comprising: a material source of a colloidal dispersion comprising electrically charged colloidal material dispersed in a fluid; a counter electrode; a flexible electrode conveyor belt adapted to convey a thin film of the colloidal suspension between the material source and the counter electrode so that the counter electrode comes in contact with the thin film colloidal dispersion opposite the flexible electrode conveyor belt, and wherein one of the counter electrode and the flexible electrode conveyor belt is a photoconductive electrode; a voltage source operably connected to produce an electric potential between the counter electrode and the flexible electrode conveyor belt that induces electrophoretic deposition on the flexible electrode conveyor belt when the photoconductive electrode is rendered conductive; and a patterned light source arranged to illuminate the photoconductive electrode with a light pattern and render conductive illuminated areas of the photoconductive electrode so that a patterned deposit of the electrically charged colloidal material is formed on the flexible electrode conveyor belt.

In another exemplary embodiment of the roll-to-roll light directed electrophoretic deposition system, the counter electrode is the photoconductive electrode.

In another exemplary embodiment of the roll-to-roll light directed electrophoretic deposition system, the flexible electrode web substrate is the photoconductive electrode.

In another exemplary embodiment of the roll-to-roll light directed electrophoretic deposition system, the flexible electrode web substrate comprises a photoconductive layer, a transparent conductive layer, and a flexible transparent backing layer.

In another exemplary embodiment, the present invention includes a roll-to-roll light-directed electrophoretic deposition method, comprising: providing means for advancing a roll of a flexible electrode web substrate along a roll-to-roll process path; providing on the flexible electrode web substrate a thin film colloidal dispersion of electrically charged colloidal material dispersed in a fluid from a material source positioned along the process path; contacting a counter electrode positioned along the process path with the thin film colloidal dispersion opposite the flexible electrode web substrate, wherein one of the counter electrode and the flexible electrode web substrate is a photoconductive electrode; providing a voltage source operably connected to produce an electric potential between the counter electrode and the flexible electrode web substrate that induces electrophoretic deposition on the flexible electrode web substrate when the photoconductive electrode is rendered conductive; and illuminating the photoconductive electrode with a light pattern from a patterned light source to render conductive illuminated areas of the photoconductive electrode so that a patterned deposit of the electrically charged colloidal material is formed on the flexible electrode web substrate.

Generally, the invention described herein is directed to a roll-to-roll printing system and method that utilizes light directed electrophoretic deposition (LD-EPD) to deposit multi-material structures efficiently in a continuous process. As a roll-to-roll system, a roll of a flexible electrode web substrate is provided and suitably advanced along a roll-to-roll process path along which various operations may take place on the flexible web substrate. It is appreciated that the flexible electrode web substrate may in the alternative be characterized as a flexible electrode tape, ribbon, strip, band, belt, roll, etc. And various mechanisms and arrangements for advancing the roll may be utilized, such as for example but not limited to drive rollers geared to and driven by motors. As an illustration, the flexible electrode web substrate may be initially provided rolled/wound on a first roller, spool, or drum (which may be gear driven), from which it is rolled out and advanced along the process path through the various process modules and stages, until it is re-collected by a pickup or collection roller, spool, or drum which may be gear driven to pull and advance the flexible electrode web substrate forward. It is appreciated that the flexible electrode web substrate may also be advanced in both forward and reverse directions to repeatedly convey the flexible electrode web substrate back to a previous module or stage for additional processing.

And a material source is positioned along the process path to provide on the flexible electrode web substrate a thin film colloidal dispersion of electrically charged colloidal material dispersed in a fluid. The colloidal dispersion particles and suspending fluid can be chosen from any appearing in the electrophoretic deposition literature, such as for example, silica in water, polystyrene in ethanol, iron in hexane, and yeast cells in water, and it may optionally contain a stabilizer to prevent settling and agglomeration of the particles. In particular, the material source may be adapted to apply or otherwise provide the thin film of colloidal suspension on the flexible electrode, such as for example, by dip coating, doctor blading, K bar coating, or spraying.

After a thin film of the colloidal dispersion is provided on the flexible electrode web substrate, the flexible electrode web substrate is advanced to a first light driven electrophoretic deposition area or stage where a counter electrode is positioned along the process path to come in contact with the thin film colloidal dispersion opposite the flexible electrode web substrate so that the thin film colloidal dispersion is positioned therebetween. It is appreciated that the flexible electrode is preferably advanced with sufficient tension, such as by roller springs attached to the ends of the flexible electrode, to prevent the flexible electrode from sagging under its own weight. The counter electrode may then be positioned such that it contacts the thin liquid film of the colloidal dispersion and is held in position by, for example, a rigid frame to oppose capillary forces from the thin liquid film as well as shear forces transmitted through the film due to the moving flexible electrode. Alternately, the counter electrode may form the bottom of a material source tank that holds the colloidal dispersion. In this case, the counter electrode may be completely submerged in the tank and held in place by tension from rollers which are positioned a fixed distance over the bottom of the tank. And because the counter electrode does not advance like the flexible electrode web substrate it can be characterized as a stationary electrode, although the counter electrode may actually be adapted to move into engagement with the thin film colloidal dispersion in some embodiments.

In any case, one of the two electrodes, counter electrode and flexible electrode web substrate, is used as a photoconductive electrode having a photoconductor that may be rendered conductive by illumination from a light source. In some embodiments, the counter electrode may be configured as the photoconductive electrode, but where a voltage potential is arranged to mobilize the electrically charged material/particles away from the counter electrode no as to produce a deposit on the flexible electrode upon rendering the counter electrode conductive. In other embodiments, the flexible electrode web substrate may be configured as the photoconductive electrode, with the voltage potential arranged to mobilize the electrically charged material/particles thereto so as to produce a deposit thereon upon rendering the flexible electrode web substrate conductive. Therefore the mobilization of the charged material in the colloidal dispersion and the inducement of electrophoretic deposition on the flexible electrode is dependent on the polarity of the electric potential produced by the voltage source between the counter electrode and the flexible electrode web substrate when the photoconductive electrode is rendered conductive. And the flexible electrode web substrate is always the working electrode, as opposed to the counter or auxiliary electrode, because the patterned deposit is formed there. The flexible electrode may be a thin, flexible metal strip, or it may be used as the photoconductor itself, in which it would be ideally comprised of a transparent flexible backing with a transparent conductor, such as indium tin oxide, fluorine tin oxide, or PEDOT with a semiconducting layer that contacts the colloidal suspension or dispersion.

And the system also includes a patterned light source arranged to illuminate the photoconductive electrode with a light pattern and renders conductive illuminated areas of the photoconductive electrode so that a patterned deposit of the electrically charged colloidal material is formed on the flexible electrode web substrate. It is appreciated that the patterned light source may employ a photomask that can be a physical mask such as a metal etched mask on glass, or a projected digital image such as a liquid crystal display. It is important that the illumination of the photomask or projected digital image be of sufficient intensity and wavelength to activate the photoconductor.

In some embodiments, different types of colloidal dispersions may also be provided to form multi-material patterned deposits. In one example embodiment, a single material source module may provide multiple types of materials, i.e. colloidal suspensions or dispersions comprising electrically charged colloidal material suspended in a fluid, for the LD-EPD process. In this case, the same counter electrode and patterned light source may be used for subsequent depositions by advancing the flexible electrode web substrate back and forth between the material source and the LD-EPD process area. And in another example embodiment, additional material sources may be provided and located elsewhere at different stages along the roll-to-roll process path of the flexible electrode web substrate. In this case, additional counter electrodes and patterned light sources may be separately provided to perform LD-EPD at the different stages.

Additionally, an optional wash module may be provided after the LD-EPD stage which is adapted to remove unadhered colloidal suspension from the flexible electrode conveyor belt or a previously electrophoretically deposited and patterned material layer. Additionally, the material source and light directed deposition areas may be staged along the path between electrodes to add additional materials. A doctor blade or knife edge may be positioned at the end run to remove the deposited film from the roller.

In some embodiments, a second set of modules may be separately provided through which the flexible electrode web substrate passes for processing. In particular, a second material source may be used which provides a second colloidal dispersion comprising electrically charged colloidal material dispersed or suspended in a fluid; and a second light-directed electrophoretic deposition stage which may be provided with a second patterned light source, a second photomask, and a second photoconductive electrode.

And characterized as a method, the roll-to-roll light-directed electrophoretic deposition method, provides a mechanism for advancing a roll of a flexible electrode web substrate along a roll-to-roll process path, and provide on the flexible electrode web substrate a thin film colloidal dispersion of electrically charged colloidal material dispersed in a fluid from a material source positioned along the process path. Next, the counter electrode is contacted with the thin film colloidal dispersion so that the counter electrode is positioned opposite the flexible electrode web substrate. A voltage source is operably connected to produce an electric potential between the counter electrode and the flexible electrode web substrate that induces electrophoretic deposition on the flexible electrode web substrate when the photoconductive electrode is rendered conductive. And finally, the photoconductive electrode is illuminated with a light pattern from a patterned light source to render conductive illuminated areas of the photoconductive electrode so that a patterned deposit of the electrically charged colloidal material is formed on the flexible electrode web substrate.

In some embodiments, the flexible electrode that is advanced through the deposition process path may, in the alternative, be characterized as a flexible electrode conveyor belt that is adapted to convey a thin film of the colloidal suspension between the material source and the counter electrode. In particular the thin film is conveyed so that the counter electrode comes in contact with the thin film colloidal dispersion opposite the flexible electrode conveyor belt. As a conveyor belt, the flexible electrode would not be the end product having the LD-EPD deposits formed thereon. Rather in this embodiment, the flexible electrode is used as a thin film transport, which after the deposition process is finished, the patterned deposit may be removed from the conveyor belt. For example, the flexible electrode conveyor belt may be unrolled from a first roller or drum, passed through the various modules to process the colloidal suspension, and rolled back onto a second roller or drum. It is appreciated that the rollers/drums may be operated in forward and reverse directions to convey the flexible electrode conveyor belt to any module of the system for processing. In such embodiments, the flexible electrode conveyor belt is adapted to return to retrieve additional colloidal suspensions (which may be the same or different from previous layers) to produce additional layers of electrophoretically deposited and patterned material layers.

In particular, as the flexible electrode conveyor belt traverses between the rollers, it first passes through a material source module such that a thin film of colloidal suspension is deposited on the flexible electrode via a method such as dip coating, doctor blading, K bar coating, or spraying. The electrode passes through the LD-EPD area where a patterned deposit is formed. It may then optionally pass through other material fountains and LD-EPD areas to add additional materials or other patterns to the deposit. The deposited film (green body) may optionally be removed from the flexible electrode with a doctor blade or knife edge. The rollers can be operated in a step-stop method where a region of flexible electrode dwells in the LD-EPD region for a fixed time, or continuous where the flexible electrode moved at a constant speed. Furthermore, the light source can be continuously on or intermittent and timed to the step-stop motion of the flexible electrode.

When a thin film of colloidal suspension is conveyed from the material source module to the region where light-directed electrophoretic deposition takes place, the patterned light source operates to illuminate the photoconductive electrode with a light pattern so that the electrically charged colloidal material of the colloidal suspension is electrophoretically deposited in an associated pattern on the flexible electrode or a previously electrophoretically deposited and patterned material layer.

BRIEF DESCRIPTION OF THE DRAWINGS

The accompanying drawings, which are incorporated into and forma a part of the disclosure, are as follows.

DETAILED DESCRIPTION

Figure 1A:
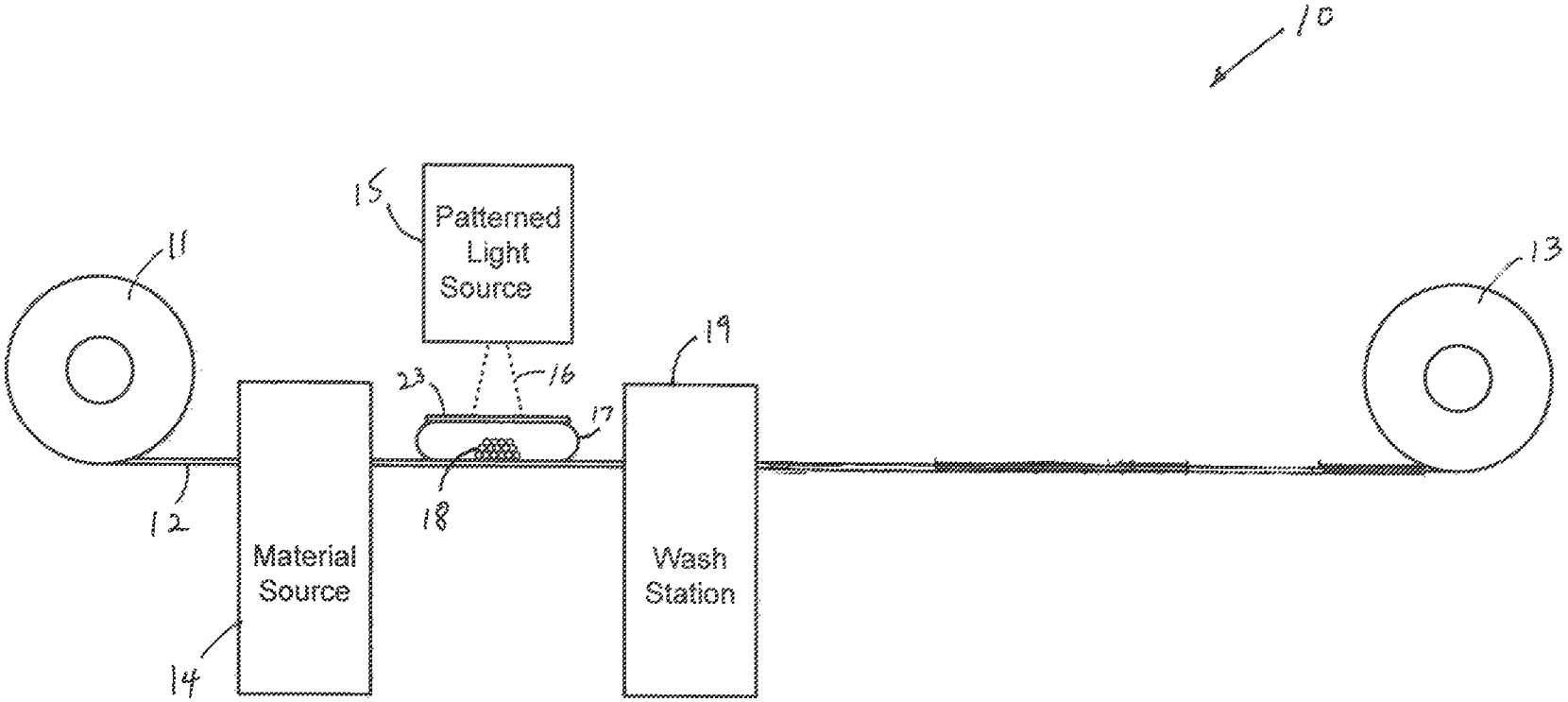
FIG. 1A is a schematic view of an example embodiment of the roll-to-roll light directed electrophoretic deposition system and method of the present invention where the counter electrode is the photoconductive electrode.

Turning now to the drawings, FIG. 1A shows a first example embodiment of the roll-to-roll light directed electrophoretic deposition system of the present invention, generally indicated at reference character 10. A roll of a flexible electrode web substrate is shown at 11 from which a flexible electrode web substrate 12 is rolled out and advanced through a roll-to-roll process path, until the flexible electrode web substrate 12 is collected by pickup or end roller 13. A material source is provided at 14 where the flexible electrode is provided with a thin film colloidal dispersion thereon, e.g. 17.

The thin film colloidal dispersion is then shown in FIG. 1A advanced to a first light directed electrophoretic deposition stage where a counter electrode 23 is shown in contact with the thin film. A patterned light source 15 is then shown selectively illuminating the counter electrode 23 with patterned light 16. While not shown in the figures, the patterned light source may include a physical photomask, a spatial light modulator, or is itself a digital display. In any case, the illumination by the patterned light source 15 induces electrophoretic deposition of charged particles in the thin film 17 so that a patterned deposit 18 is formed on the flexible electrode web substrate. At this point, the flexible electrode web substrate may be optionally washed in a first wash station 19 to remove unadhered colloidal dispersion. While a voltage source is not shown in FIG. 1A, it is appreciated that it would be operably connected to the counter electrode 23 as well as the flexible electrode 12.

Figure 1B:
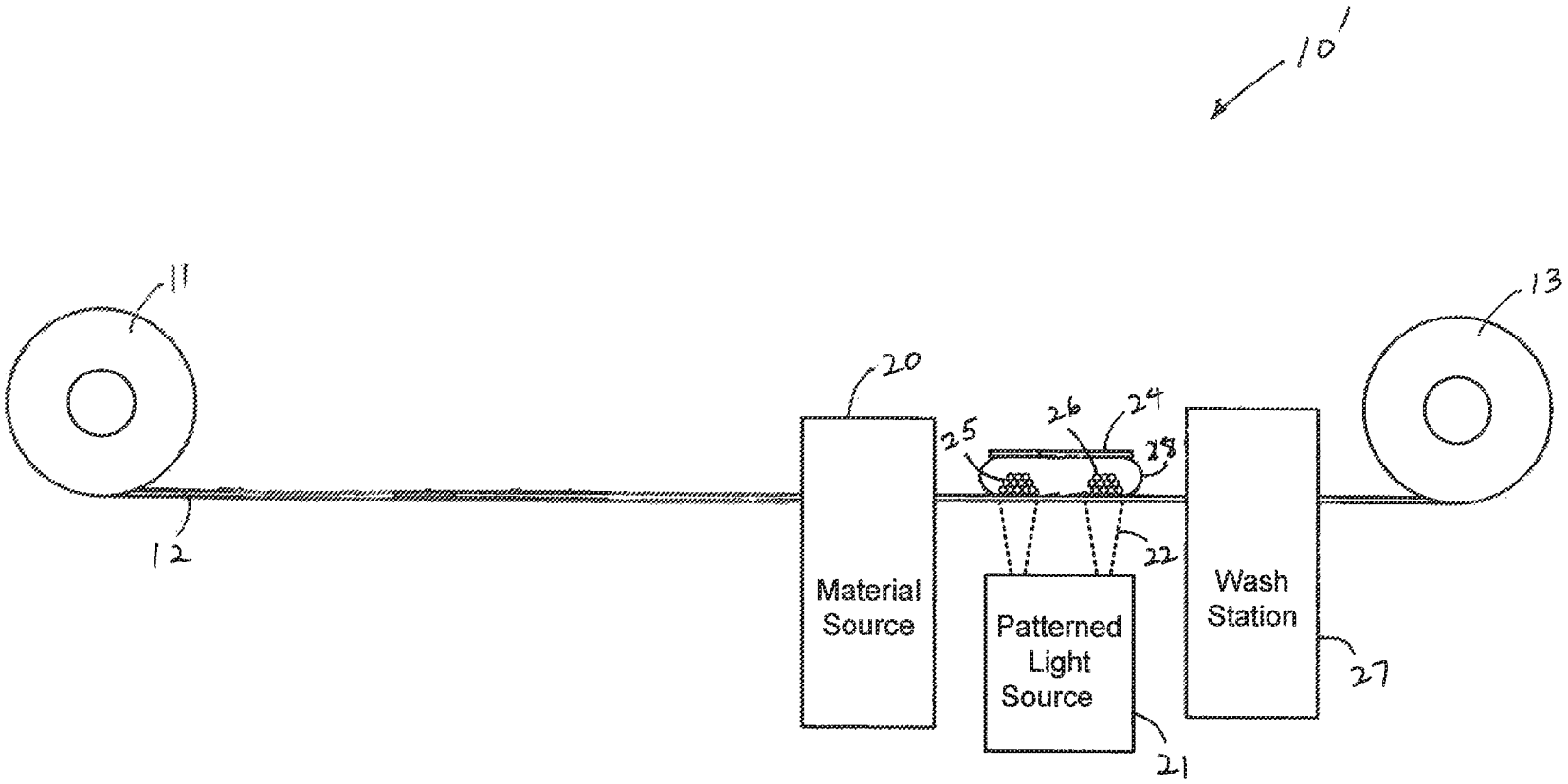
FIG. 1B is a schematic view of an example embodiment of the roll-to-roll light directed electrophoretic deposition system and method of the present invention where the flexible electrode web substrate is the photoconductive electrode.

And FIG. 1B shows another example embodiment of the roll-to-roll light directed electrophoretic deposition system of the present invention, generally indicated at reference character 10'. Similar to FIG. 1A a roll of a flexible electrode web substrate is shown at 11 from which a flexible electrode web substrate 12 is rolled out and advanced through a roll-to-roll process path, until the flexible electrode web substrate 12 is collected by pickup or end roller 13. A material source is provided at 20 where the flexible electrode is provided with a thin film colloidal dispersion thereon, e.g. 28. The thin film colloidal dispersion is then shown in FIG. 1B advanced to a light directed electrophoretic deposition stage where a counter electrode 24 is shown in contact with the thin film. As shown, the thin film colloidal dispersion 28 is provided and brought into contact with counter electrode 24, and further illuminated with patterned light 22 provided by a patterned light source 21, to induce electrophoretic deposition of charged particles in the thin film 28 so that patterned deposits 25 and 26 are formed on the flexible electrode web substrate. Additional washing may optionally take place at wash station 27. At this point, the patterned deposits may be removed prior to collection of the flexible electrode on roll/spool 13, or collected altogether with the flexible electrode web substrate. While a voltage source is not shown in FIG. 1B, it is appreciated that it would be operably connected to the counter electrode 24 as well as the flexible electrode 12. And similar to FIG. 1A, while not shown in the figures, the patterned light source may include a physical photomask, a spatial light modulator, or is itself a digital display.

Figure 2:
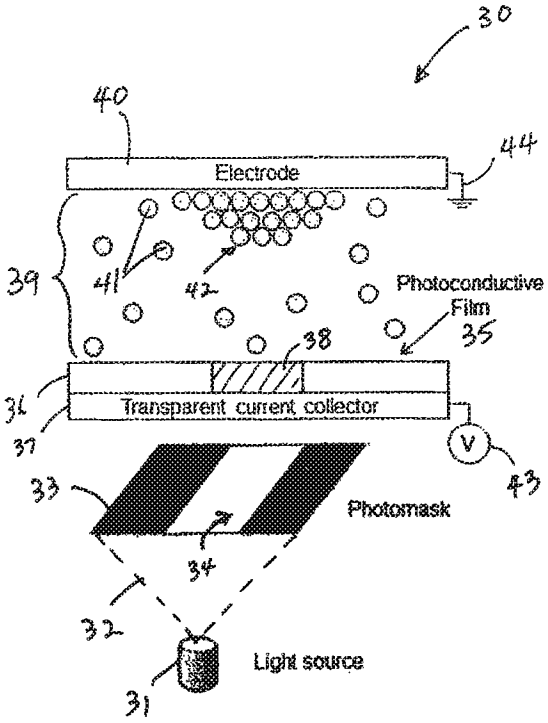
FIG. 2 is an enlarge schematic view of another example of the roll-to-roll light directed electrophoretic deposition system and method of the present invention having the counter electrode be the photoconductive electrode with electrophoretic deposition shown occurring on the flexible electrode.

FIG. 2 shows an enlarged schematic view of an example embodiment where the photoconductive electrode is assigned to the counter electrode that is connected to voltage potential 43, and shown particularly as a photoconductive film 35 having a photoconductive layer 36 and a transparent current collector layer 37. Electrode 40 is the flexible electrode web substrate shown connected to electrical ground 44. Between the flexible electrode 40 and the counter electrode 35, a thin film colloidal dispersion 39 is shown having charged particles 42 suspended or dispersed in a fluid. And upon illumination by light source 31, the light 32 is patterned by photomask 33 having an opening 34. The patterned light produced in this manner renders conductive the region 38 of the photoconductive layer 36 which establishes the voltage potential across the electrodes. However, because of the polarity of the voltage source, the light driven electrophoretic deposition of the patterned deposition 42 is shown formed on the flexible electrode 40.

Figure 3:
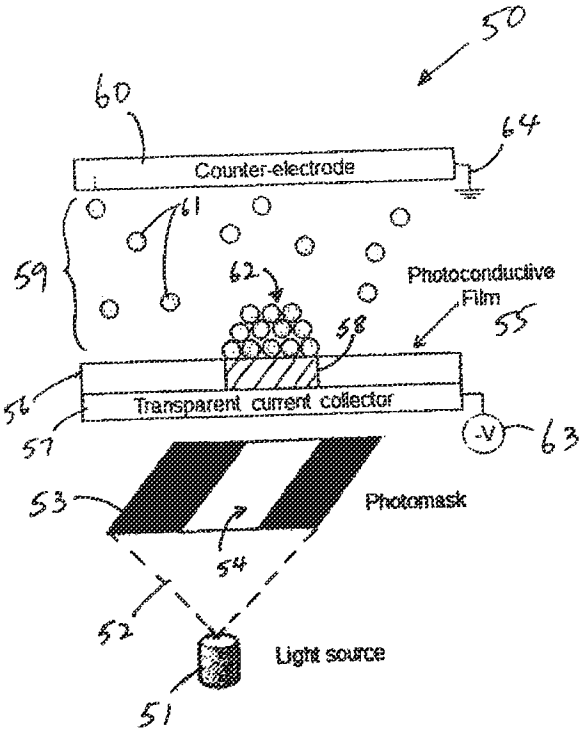
FIG. 3 is an enlarge schematic view of another example of the roll-to-roll light directed electrophoretic deposition system and method of the present invention having the flexible electrode be the photoconductive electrode with electrophoretic deposition shown occurring on the flexible electrode.

FIG. 3 shows another enlarged schematic view of an example embodiment of the LD-EPD system of the present invention, but where the photoconductive electrode is assigned to the flexible electrode web substrate that is connected to voltage potential 43, and shown particularly as a photoconductive film 55 having a photoconductive layer 56 and a transparent current collector layer 57. Electrode 60 is the flexible electrode web substrate shown connected to electrical ground 64. Between the flexible electrode 60 and the counter electrode 55, a thin film colloidal dispersion 59 is shown having charged particles 61 suspended or dispersed in a fluid. And upon illumination by light source 51, the light 52 is patterned by photomask 53 having an opening 54. The patterned light produced in this manner renders conductive the region 58 of the photoconductive layer 56 which establishes the voltage potential across the electrodes. However, because of the polarity of the voltage source, the light driven electrophoretic deposition of the patterned deposition 62 is shown formed on the flexible electrode 60.

Figure 4:
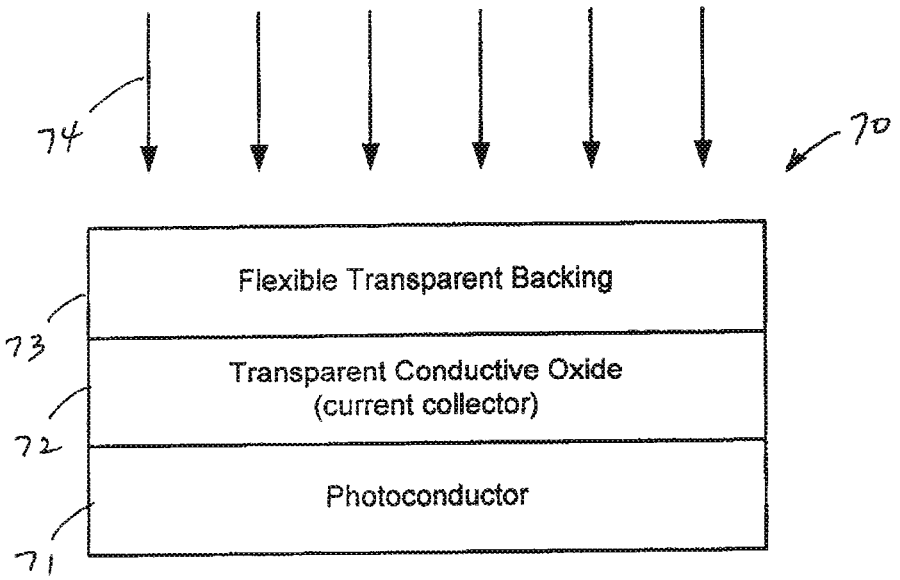
FIG. 4 is an enlarged cross-section view of an example embodiment of the photoconductive electrode which may be used as either the counter electrode or the flexible electrode web substrate.

And FIG. 4 shows an example embodiment of a photoconductive electrode 70 which may be used for either the counter electrode or the flexible electrode web substrate. In particular, the photoconductive electrode is shown having a photoconductor layer 71, a transparent conductive layer 72, particularly shown as a transparent conductive oxide, which is used as a current collector, and a flexible transparent backing layer 73. Patterned light 74 is shown directed into the electrode 70 from the flexible transparent backing, which is on a back side of the electrode opposite the thin film colloidal dispersion. It is appreciated that the transparent conductive layer may also be a transparent metal mesh electrode.

Although the description above contains many details and specifics, these should not be construed as limiting the scope of the invention but as merely providing illustrations of some of the presently preferred embodiments of this invention. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present invention fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

We claim:

1. A roll-to-roll light-directed electrophoretic deposition system, comprising:

means for advancing a roll of a flexible electrode web substrate along a roll-to-roll process path;

a material source positioned along the process path to provide on the flexible electrode web substrate a thin film colloidal dispersion of electrically charged colloidal material dispersed in a fluid;

a counter electrode positioned along the process path to come in contact with the thin film colloidal dispersion opposite the flexible electrode web substrate, wherein one of the counter electrode and the flexible electrode web substrate is a photoconductive electrode;

a voltage source operably connected to produce an electric potential between the counter electrode and the flexible electrode web substrate that induces electrophoretic deposition of the electrically charged colloidal material on the flexible electrode web substrate when the photoconductive electrode is rendered conductive; and a patterned light source arranged to illuminate the photoconductive electrode with a light pattern and render conductive illuminated areas of the photoconductive electrode so that a patterned deposit of the electrically charged colloidal material is thereby electrophoretically deposited on the flexible electrode web substrate.

2. The roll-to-roll light directed electrophoretic deposition system of claim 1, wherein the counter electrode is the photoconductive electrode.

3. The roll-to-roll light directed electrophoretic deposition system of claim 1, wherein the flexible electrode web substrate is the photoconductive electrode.

4. The roll-to-roll light directed electrophoretic deposition system of claim 3, wherein the flexible electrode web substrate comprises a photoconductive layer, a transparent conductive layer, and a flexible transparent backing layer.

5. A roll-to-roll light directed electrophoretic deposition system, comprising:

a material source of a colloidal dispersion comprising electrically charged colloidal material dispersed in a fluid;

a counter electrode;

a flexible electrode conveyor belt adapted to convey a thin film of the colloidal suspension between the material source and the counter electrode so that the counter electrode comes in contact with the thin film colloidal dispersion opposite the flexible electrode conveyor belt, and wherein one of the counter electrode and the flexible electrode conveyor belt is a photoconductive electrode;

a voltage source operably connected to produce an electric potential between the counter electrode and the flexible electrode conveyor belt that induces electrophoretic deposition of the electrically charged colloidal material on the flexible electrode conveyor belt when the photoconductive electrode is rendered conductive; and a patterned light source arranged to illuminate the photoconductive electrode with a light pattern and render conductive illuminated areas of the photoconductive electrode so that a patterned deposit of the electrically charged colloidal material is thereby electrophoretically deposited on the flexible electrode conveyor belt.

6. The roll-to-roll light directed electrophoretic deposition system of claim 5, wherein the counter electrode is the photoconductive electrode.

7. The roll-to-roll light directed electrophoretic deposition system of claim 5, wherein the flexible electrode web substrate is the photoconductive electrode.

8. The roll-to-roll light directed electrophoretic deposition system of claim 7, wherein the flexible electrode web substrate comprises a photoconductive layer, a transparent conductive layer, and a flexible transparent backing layer.

9. A roll-to-roll light-directed electrophoretic deposition method, comprising:

providing means for advancing a roll of a flexible electrode web substrate along a roll-to-roll process path;

providing on the flexible electrode web substrate a thin film colloidal dispersion of electrically charged colloidal material dispersed in a fluid from a material source positioned along the process path;

contacting a counter electrode positioned along the process path with the thin film colloidal dispersion opposite the flexible electrode web substrate, wherein one of the counter electrode and the flexible electrode web substrate is a photoconductive electrode;

providing a voltage source operably connected to produce an electric potential between the counter electrode and the flexible electrode web substrate that induces electrophoretic deposition of the electrically charged colloidal material on the flexible electrode web substrate when the photoconductive electrode is rendered conductive; and illuminating the photoconductive electrode with a light pattern from a patterned light source to render conductive illuminated areas of the photoconductive electrode so that a patterned deposit of the electrically charged colloidal material is thereby electrophoretically deposited on the flexible electrode web substrate.

* * * * *